US009129570B2

(12) United States Patent
Cho et al.

(10) Patent No.: US 9,129,570 B2
(45) Date of Patent: Sep. 8, 2015

(54) DISPLAY APPARATUS

(71) Applicant: Samsung Display Co., Ltd., Yongin (KR)

(72) Inventors: Jaehyun Cho, Seoul (KR); Sung-Jin Hong, Hwaseong-si (KR); Jae-Byung Park, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 50 days.

(21) Appl. No.: 14/050,953

(22) Filed: Oct. 10, 2013

(65) Prior Publication Data

US 2014/0266995 A1 Sep. 18, 2014

(30) Foreign Application Priority Data

Mar. 12, 2013 (KR) ..... 10-2013-0026341

(51) Int. Cl.
*G09G 3/36* (2006.01)
*G09G 3/20* (2006.01)

(52) U.S. Cl.
CPC ..... *G09G 3/3607* (2013.01); *G09G 3/2077* (2013.01); *G09G 3/3614* (2013.01); *G09G 3/3648* (2013.01); *G09G 2310/0235* (2013.01)

(58) Field of Classification Search
CPC . G09G 3/3648; G09G 3/3614; G09G 3/3688; G09G 3/3611; G09G 3/3655; G09G 2320/043; G09G 3/3233; G09G 2300/0842; G09G 2300/0861; G09G 2320/0233
USPC ..... 345/87–88, 38
See application file for complete search history.

(56) References Cited

U.S. PATENT DOCUMENTS

| | | | |
|---|---|---|---|
| 6,903,718 | B2 | 6/2005 | Son |
| 7,248,314 | B2 | 7/2007 | Yun |
| 7,333,165 | B2 | 2/2008 | Nakano et al. |
| 7,336,325 | B2 | 2/2008 | Hong |
| 7,580,023 | B2 | 8/2009 | Pugh et al. |
| 7,656,476 | B2 | 2/2010 | So |
| 7,679,598 | B2 | 3/2010 | Tsumura et al. |
| 7,782,283 | B2 | 8/2010 | Hong et al. |
| 7,796,106 | B2 | 9/2010 | Ha |
| 7,952,544 | B2 | 5/2011 | Roberts |
| 8,022,924 | B2 | 9/2011 | Weng et al. |

(Continued)

FOREIGN PATENT DOCUMENTS

| | | |
|---|---|---|
| JP | 2006-126347 | 5/2006 |
| JP | 2011-128562 | 6/2011 |

(Continued)

*Primary Examiner* — M D Saiful A Siddiqui
(74) *Attorney, Agent, or Firm* — H.C. Park & Associates, PLC

(57) ABSTRACT

A display apparatus, includes: a display panel including: gate lines extended in a first direction, data lines extended in a second direction, sub-pixels, and a first color filter, a second color filter, and a substantially colorless portion sequentially arranged in the first direction in one-to-one correspondence with the sub-pixels; and a light providing unit configured to supply a first color of light and a second color of light different from the first color of light to the display panel in association with a first sub-frame and a second sub-frame, respectively. At least some of the sub-pixels are grouped into a sub-pixel group including an "a"×"b" matrix arrangement, the sub-pixel group being connected to an amount "a" of the gate lines and an amount "b" of the data lines, and "a" and "b" are positive integers greater than zero and "b" is greater than "a."

14 Claims, 7 Drawing Sheets

(56) References Cited

U.S. PATENT DOCUMENTS

| | | | | |
|---|---|---|---|---|
| 8,106,872 | B2 | 1/2012 | Tsai et al. | |
| 8,115,725 | B2 | 2/2012 | Shin et al. | |
| 2008/0165102 | A1* | 7/2008 | Tsai et al. | 345/88 |
| 2008/0191987 | A1* | 8/2008 | Lee et al. | 345/92 |
| 2009/0140253 | A1* | 6/2009 | Kasahara | 257/59 |
| 2009/0225103 | A1* | 9/2009 | Shiomi | 345/690 |
| 2010/0013803 | A1* | 1/2010 | Noguchi et al. | 345/204 |
| 2010/0188322 | A1 | 7/2010 | Furukawa | |
| 2011/0169871 | A1* | 7/2011 | Suzuki et al. | 345/690 |

FOREIGN PATENT DOCUMENTS

| | | | |
|---|---|---|---|
| KR | 10-2007-0002452 | | 1/2007 |
| KR | 10-2008-0002301 | | 1/2008 |
| KR | 10-2008-0049357 | | 6/2008 |
| KR | 10-2008-0061778 | | 7/2008 |
| KR | 10-2008-0086164 | | 9/2008 |
| KR | 10-2009-0007033 | | 1/2009 |
| KR | 10-2009-0007035 | | 1/2009 |
| KR | 10-2009-0116530 | | 11/2009 |
| WO | WO 2012/029701 | * | 3/2012 |

* cited by examiner

DISPLAY APPARATUS

CROSS-REFERENCE TO RELATED APPLICATION

This application claims priority from and the benefit of Korean Patent Application No. 10-2013-0026341, filed on Mar. 12, 2013, which is incorporated by reference for all purposes as if set forth herein.

BACKGROUND

1. Field

Exemplary embodiments relate to display technology, and more particularly, to a display apparatus configured to improve display quality.

2. Discussion

A conventional display apparatus may be configured to realize a full color image using a space (or spatial) division scheme, such as a spatial color dithering scheme. To this end, a display panel of the display device may include red, green, and blue color filters arranged, such as repeatedly arranged, to correspond to sub-pixels in a one-to-one correspondence. In this manner, a combination of the red, green, and blue color filters may serve as a minimum unit to realize a color, and the full color image may be realized by a transmittance difference between the sub-pixels of the display panel and the color combination of the red, green, and blue color filters. In other words, spatial diffusion may be achieved by presenting various available colors (via the color filters) at a plurality of differently disposed pixels (or sub-pixels) to approximate a non-native color (i.e., colors not in the "color space" of the display apparatus) over the region occupied by the plurality of differently disposed pixels/sub-pixels. As described above, an arrangement in which the red, green, and blue color filters are arranged in different spaces may be referred to as a space (or spatial) division scheme.

Alternatively (or additionally), a time (or temporal) division scheme (or a field sequential scheme), configured to realize the full color image with high transmittance and low manufacturing cost, may be used, such as a temporal color dithering technique. In a time division scheme, the color filters may be omitted from the display panel and a backlight unit disposed at a rear side of the display panel may include red, green, and blue light sources respectively configured to emit red, green, and blue color lights. It is noted that the backlight unit may include one or more light emitters disposed at one or more sides of the display panel. In addition, a frame may be divided into a plurality of fields (or sub-frames), such as three fields, separated in time from each other, and the red, green, and blue light sources may be lit in the three fields, respectively. In this manner, the display device may sequentially (or otherwise) display red, green, and blue color images. An observer may autonomically perceive the full color image obtained by combining the red, green, and blue color images by a physiological visual sensation. In other words, temporal diffusion may be achieved by rapidly alternating the color value of one or more pixels and/or sub-pixels between various native colors (i.e., colors associated with the red, green, and blue light sources) to approximate a non-native color in a region corresponding to the one or more pixels and/or sub-pixels.

Typically, utilization of a time division scheme to create the illusion of color depth may be associated with a "color breakup" effect, in which the red, green and blue color images are separately perceived by an observer in addition to (or instead of) the intended color mixture. This color breakup effect momentarily occurs when, for instance, a viewpoint is changed due to an observer blinking their eyes or the movement of the observer, which may occur regardless of high transmittance and/or low manufacturing cost.

Therefore, there is a need for an approach that provides efficient, cost effective techniques to improve display quality.

The above information disclosed in this Background section is only for enhancement of understanding of the background of the present disclosure, and, therefore, it may contain information that does not form the prior art that is already known in this country to a person of ordinary skill in the art.

SUMMARY

Exemplary embodiments provide a display apparatus configured to improve display quality.

Additional aspects will be set forth in the detailed description which follows and, in part, will be apparent from the disclosure, or may be learned by practice of the invention.

According to exemplary embodiments, a display apparatus, includes: a display panel including: gate lines extended in a first direction, data lines extended in a second direction, sub-pixels, and a first color filter, a second color filter, and a substantially colorless portion sequentially arranged in the first direction in one-to-one correspondence with the sub-pixels; and a light providing unit configured to supply a first color of light and a second color of light different from the first color of light to the display panel in association with a first sub-frame and a second sub-frame, respectively. At least some of the sub-pixels are grouped into a sub-pixel group including an "a"×"b" matrix arrangement, the sub-pixel group being connected to an amount "a" of the gate lines and an amount "b" of the data lines, and "a" and "b" are positive integers greater than zero and "b" is greater than "a."

According to exemplary embodiments, the number of gate lines arranged in the display panel may be reduced, and, as such, an associated charging time of each pixel may be increased. In this manner, the display quality of an image displayed on the display panel may be improved, as may be the illusion of color depth associated with the image.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
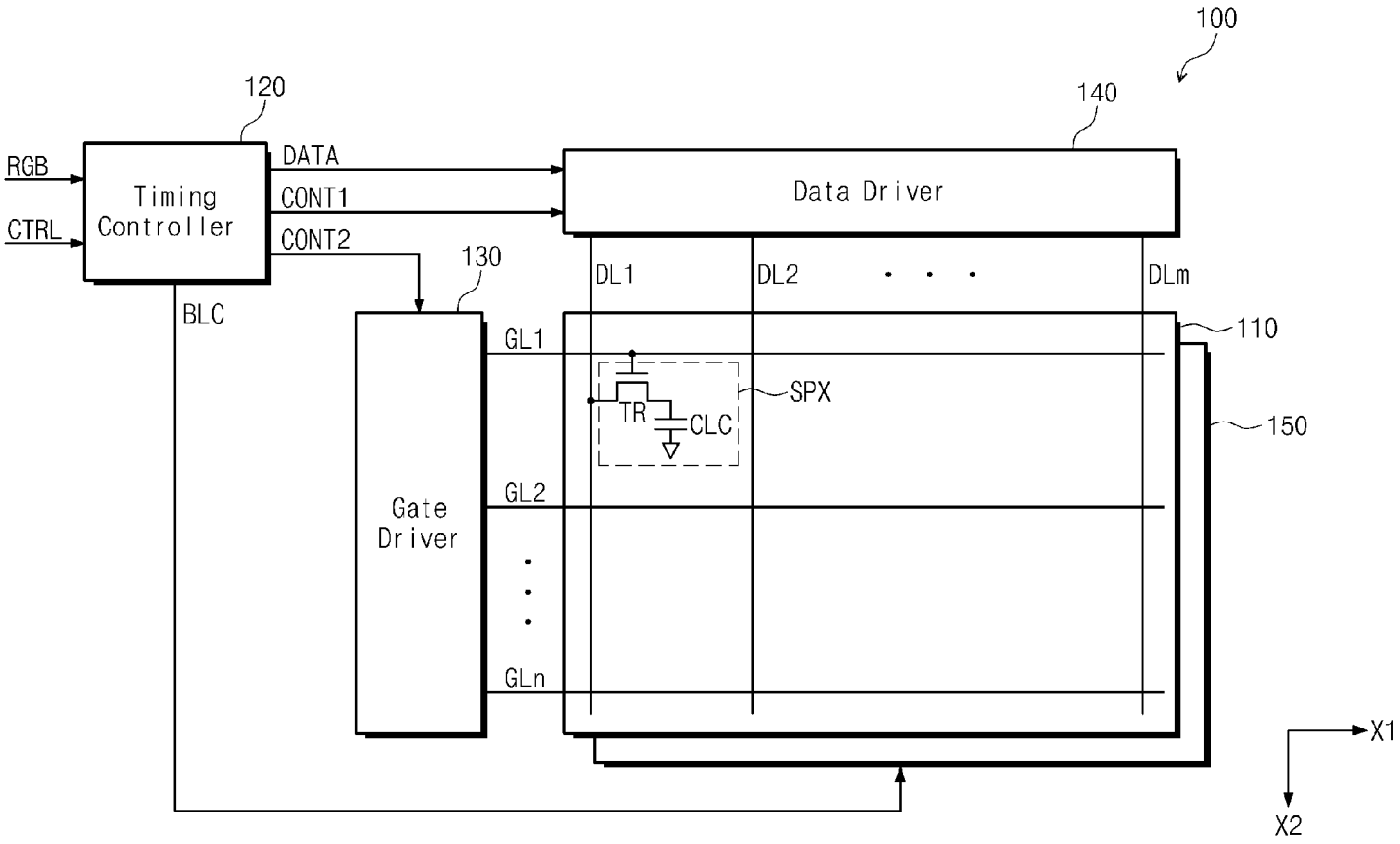
FIG. 1 is a block diagram of a display apparatus, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc., may be used herein to describe various elements, components, regions, layers and/or sections, these elements, components, regions, layers and/or sections should not be limited by these terms. These terms are used to distinguish one element, component, region, layer or section from another element, component, region, layer, or section. Thus, a first element, component, region, layer or section discussed below could be termed a second element, component, region, layer or section without departing from the teachings of the present disclosure.

Spatially relative terms, such as "beneath," "below," "lower," "above," "upper," and/or the like, may be used herein for descriptive purposes, and, thereby, to describe one element or feature's relationship to another element(s) or feature (s) as illustrated in the drawings. Spatially relative terms are intended to encompass different orientations of an apparatus in use or operation in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art, and will not be interpreted in an idealized or overly formal sense, unless expressly so defined herein.

While exemplary embodiments are described in association with liquid crystal display devices, it is contemplated that exemplary embodiments may be utilized in association with other or equivalent display devices, such as various self-emissive and/or non-self-emissive display technologies. For instance, self-emissive display devices may include organic light emitting displays (OLED), plasma display panels (PDP), etc., whereas non-self-emissive display devices may include electrophoretic displays (EPD), electrowetting displays (EWD), etc.

FIG. 1 is a block diagram of a display apparatus, according to exemplary embodiments.

Referring to FIG. 1, a display apparatus (or device) 100 includes a display panel 110, a timing controller 120, a gate driver 130, a data driver 140, and a backlight unit 150. While specific reference will be made to this particular implementation, it is also contemplated that the display device may embody many forms and include multiple and/or alternative components. For example, it is contemplated that the components of the display device may be combined, located in separate structures, and/or separate locations.

According to exemplary embodiments, the display panel 110 includes a plurality of data lines DL1 to DLm extended in a first (e.g., horizontal) direction X1, a plurality of gate lines GL1 to GLn extended in a second (e.g., vertical) direction X2 to cross the data lines DL1 to DLm, and a plurality of sub-pixels SPX arranged in areas defined by the data lines DL1 to DLm crossing the gate lines GL1 to GLn, such as arranged in a matrix form. It is noted that each of "n" and "m" is a natural number greater than zero (0). Further, the data lines DL1 to DLm are insulated from the gate lines GL1 to GLn.

Each sub-pixel SPX includes a switching element TR connected to a corresponding data line of the data lines DL1 to DLm and a corresponding gate line of the gate lines GL1 to GLn. To this end, each sub-pixel further includes a liquid crystal capacitor CLC connected to the switching element TR.

According to exemplary embodiments, the sub-pixels SPX have the same structure. Therefore, one sub-pixel will be described in detail as a representative example of the sub-pixels SPX. It is contemplated, however, that any suitable number of configurations of sub-pixels may be utilized in association with exemplary embodiments described herein. As seen in FIG. 1, however, the switching element TR of each sub-pixel includes a first (e.g., gate) electrode connected to a gate line GL1 of the gate lines GL1 to GLn, a second (e.g., source) electrode connected to a data line DL1 of the data lines DL1 to DLm, and a third (e.g., drain) electrode connected to the liquid crystal capacitor CLC. A terminal of the liquid crystal capacitor CLC is connected to the third electrode of the switching element TR, and the other terminal of the liquid crystal capacitor CLC is connected to a common voltage. The switching element TR may be any suitable component, such as, for example, a thin film transistor (TFT).

The timing controller 120 is configured to receive image signals RGB and control signals CTRL, e.g., a vertical synchronization signal, a horizontal synchronization signal, a main clock signal, a data enable signal, etc., to control the image signals RGB. The timing controller 120 may convert the image signal RGB to a data signal(s) DATA that may be utilized in association with an operation condition of the display panel 110 employed based on the control signals CTRL. The timing controller 120 may apply the data signal DATA and a first control signal(s) CONT1 to the data driver 140 and a second control signal(s) CONT2 to the gate driver 130. The first control signal CONT1 may include a horizontal synchronization start signal, a clock signal, a line latch signal, etc., and the second control signal CONT2 may include a vertical synchronization start signal, an output enable signal, a gate pulse signal, etc.

The data driver 140 is configured to output gray-scale voltages to drive the data lines DL1 to DLm in response to the data signal DATA and the first control signal CONT1 received from, for example, the timing controller 120.

The gate driver 130 is configured to drive the gate lines GL1 to GLn in response to the second control signal CONT2 received from, for instance, the timing controller 120. The gate driver 130 includes one or more gate driver integrated circuits (ICs), but the gate driver 130 may include any other suitable configuration, such as noted below. That is, the gate driver 130 may be configured to include a circuit made of one or more oxide semiconductors, amorphous semiconductors, crystalline semiconductors, and/or polycrystalline semiconductors.

According to exemplary embodiments, the timing controller 120, the gate driver 130, and/or the data driver 140, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the processes described herein to facilitate image signal processing and the display of images via display device 100 may be implemented via software, hardware (e.g., general processor, Digital Signal Processing (DSP) chip, an Application Specific Integrated Circuit (ASIC), Field Programmable Gate Arrays (FPGAs), etc.), firmware, or a combination thereof. In this manner, the display device of FIG. 1 may include or otherwise be associated with one or more memories including code (e.g., instructions) configured to cause the display device 100 to perform one or more of the processes and/or features described herein.

The memories may be any medium that participates in providing code/instructions to the one or more software, hardware, and/or firmware for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

According to exemplary embodiments, when a gate on voltage VON is applied to a gate line (e.g., gate line GL1), switching element TR arranged in an associated row and connected to the gate line may be "turned on." In this manner, the data driver 140 may apply the gray-scale voltages corresponding to the data signal DATA to the data lines DL1 to DLm. The gray-scale voltages applied to the data lines DL1 to DLm may be applied to corresponding sub-pixels SPX via the "turned-on" switching element TR of the associated row. A period in which the switching element TR corresponding to the row are "turned on," e.g., a period of the output enable signal OE, may be referred to as "a horizontal period" or "1H."

The backlight unit 150 is disposed at a rear side of the display panel 110 and may be configured to supply light to the display panel 110. It is noted that one or more light emitters (not shown) of the backlight unit 150 may be disposed behind or at one or more sides of the display panel 110. In this manner, the backlight unit 150 may comprise or otherwise be substituted or augmented by any suitable light providing unit.

As an example, the backlight unit 150 may include a plurality of light emitting diodes (not shown) as its light source; however, any other suitable light source may be utilized. In this manner, the light emitting diodes may be arranged on a printed circuit board in a stripe form, matrix form, etc.

Figure 2:
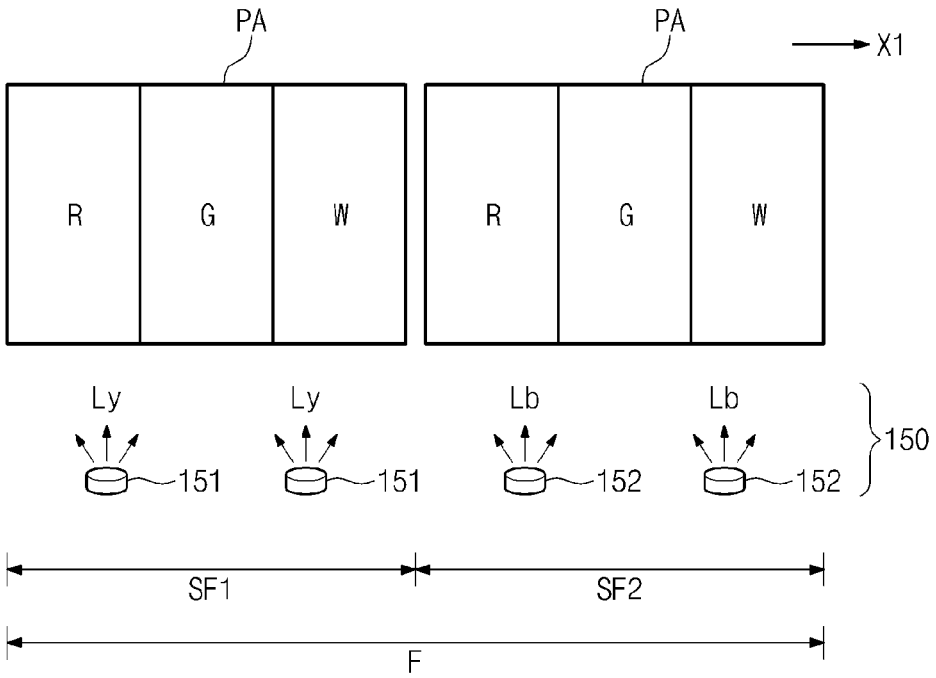
FIG. 2 schematically illustrates realization of a "full color" image using spatial and/or temporal division schemes, according to exemplary embodiments.

FIG. 2 schematically illustrates realization of a "full color" image using spatial and/or temporal division schemes, according to exemplary embodiments.

Referring to FIG. 2, the display panel 110 of FIG. 1, to which the spatial and/or temporal division schemes may be applied, may include a first color filter and a second color filter, which have similar or different colors from each other. As an example, the first and second color filters may include a red color filter R to produce a red color and a green color filter G to produce a green color. It is contemplated; however, that any other suitable colors and/or number of colors might be utilized. When an area corresponding to one pixel is referred to as a pixel area PA, each pixel area PA may include the red and green color filters R and G. In addition, each pixel area PA may include an open (or substantially colorless) portion W. The first color filter R, the second color filter G, and the open portion W may be sequentially arranged in the first direction X1; however, any other suitable arrangement may be utilized. The first color filter R, the second color filter G, and the open portion W, respectively, may correspond to three sub-pixels in a pixel area PA. While three sub-pixels are illustrated in association with a pixel area PA, it is contemplated that any suitable number of sub-pixel areas may be utilized, as well as any suitable number of colors and associated color filters. The open portion W may correspond to a substantially transparent filter disposed on a same or different plane as the first and second color filters, such as the red and green color filters R and G.

According to exemplary embodiments, the backlight unit 150 of FIG. 1 may include a first light source 151 configured to emit a first color of light Ly and a second light source 152 configured to emit a second color light Lb. A frame F may be divided into sub-frames, such as two sub-frames, e.g., a first sub-frame SF1 and a second sub-frame SF2, according to a time sequence. In the first sub-frame SF1, the first light source 151 may be driven and the first color of light Ly may exit from the backlight unit 150 to, thereby, supply the first color of light Ly to the display panel 110. In the second sub-frame SF2, the second light source 152 may be driven and the second color of light Lb may exit from the backlight unit 150 to, thereby, supply the second color of light Lb to the display panel 110. While two light sources 151 and 152, two sub-frames SF1 and SF2, and two colors of light Ly and Lb are illustrated, it is contemplated that any suitable number of light sources, sub-frames, and/or colors of light may be utilized.

According to exemplary embodiments, the first color of light Ly exiting from the first light source 151 may be a yellow color of light and the second color of light Lb exiting from the second light source 152 may be a blue color light. It is contemplated; however, that any other suitable color may be utilized. When, however, the first color of light Ly is the yellow color of light, the first color of light Ly includes a red light component and a green light component. As such, the red light component of the first color of light Ly radiating from the backlight unit 150 in the first sub-frame SF1 may pass (or otherwise propagate) through the first color filter R and may be displayed as a red image. The green light component of the first color of light Ly may pass through the second color filter G and may be displayed as a green image. The first color of light Ly may pass through the open portion W and may be displayed as a yellow image. To this end, the second color of light Lb radiating from the backlight unit 150 in the second sub-frame SF2 may pass (or otherwise propagate) through the open portion W and may be displayed as a blue image.

As described above, the open portion W is prepared to provide a space in which the yellow image is displayed in association with the first sub-frame SF1 and the blue image is displayed in association with the second sub-frame SF2. When the yellow image and the blue image are alternately displayed in a temporal division scheme, a white image may be perceived. In this manner, the open portion W may be configured to prevent the color breakup effect from occurring when the temporal division scheme is utilized, as well as may be configured to enhance brightness of the associated display device. Further, the size of the open portion W may be determined in accordance with a transmittance level suitable to achieve a desired brightness and/or desired color for a frame.

As described above, the red image and the green image may be displayed via a spatial division scheme using the first color filter R and the second color filter G, such that the yellow image and the blue image may be alternately displayed via a temporal division scheme to, thereby, realize the display of a "full color" image.

Figure 3:
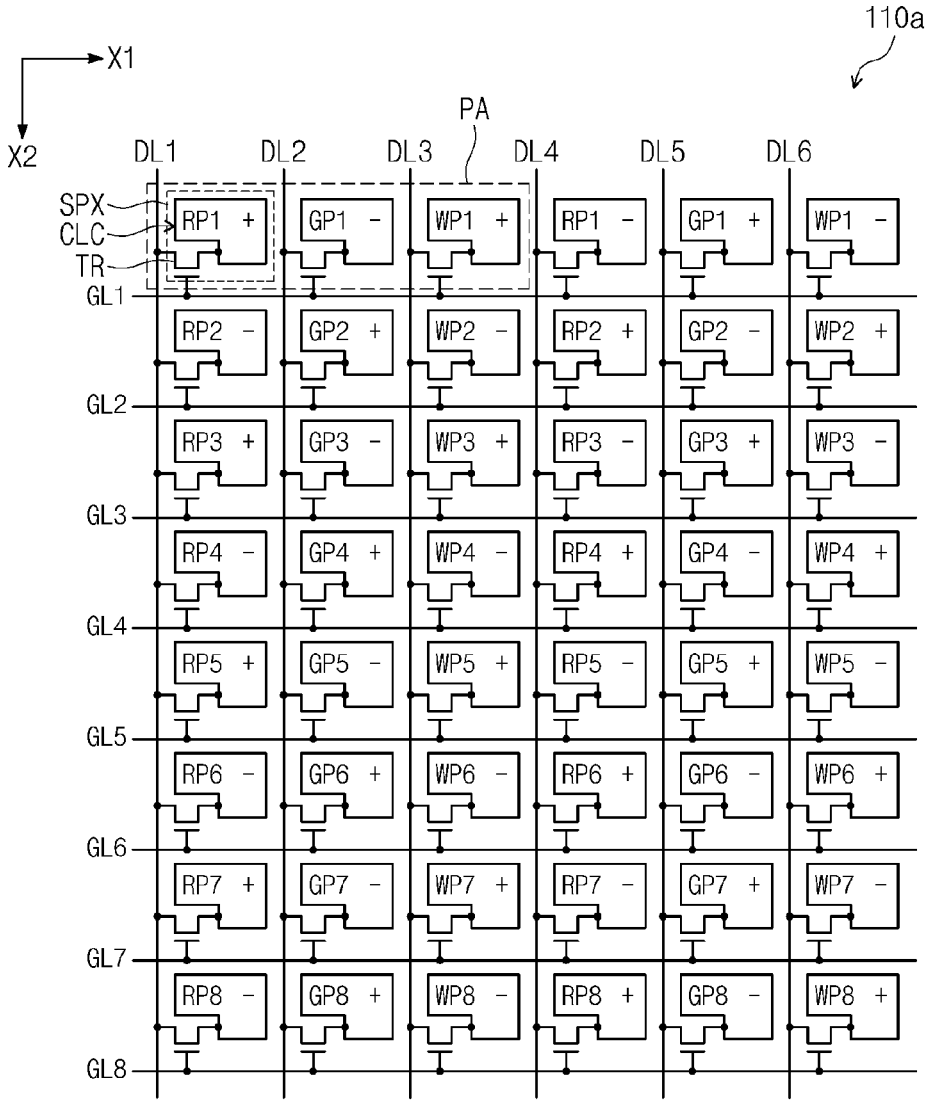
FIG. 3 schematically illustrates an arrangement of sub-pixels in a display panel of the display apparatus of FIG. 1, according to exemplary embodiments.

FIG. 3 schematically illustrates an arrangement of sub-pixels in the display panel 110 of the display device 100 of FIG. 1, according to exemplary embodiments.

Referring to FIG. 3, a display panel 110*a* includes a plurality of sub-pixels. The sub-pixels have the same structure and function, and, therefore, to avoid obscuring exemplary embodiments described herein, one sub-pixel SPX will be described in detail. The sub-pixel SPX includes a switching element TR and a liquid crystal capacitor CLC. The switching element TR is connected to a corresponding data line DL1 and a corresponding gate line GL1.

As described with reference to FIG. 2, the first color filter R, the second color filter G, and the open portion W respectively correspond to three sub-pixels in the pixel area PA. Hereinafter, among the three sub-pixels, the sub-pixel corresponding to the first color filter R is referred to as a red sub-pixel RP, the sub-pixel corresponding to the second color filter G is referred to as a green sub-pixel GP, and the sub-pixel corresponding to the open portion W is referred to as a transparent sub-pixel WP.

The red sub-pixel RP, the green sub-pixel GP, and the transparent sub-pixel WP may be sequentially and alternately arranged in the first direction X1. The sub-pixels corresponding to the same color may be arranged in the second direction X2. For instance, first to eighth red sub-pixels RP1 to RP8 connected to a first data line DL1 are sequentially arranged in the second direction X2. First to eighth green sub-pixels GP1 to GP8 connected to a second data line DL2 are sequentially arranged in the second direction X2. First to eighth transparent sub-pixels WP1 to WP8 connected to a third data line DL3 are sequentially arranged in the second direction X2.

As seen in FIG. 3, the first red sub-pixel RP1, the first green sub-pixel GP1, and the first transparent sub-pixel WP1, which are sequentially and alternately arranged in the first direction X1, are connected to the first gate line GL1. The second red sub-pixel RP2, the second green sub-pixel GP2, and the second transparent sub-pixel WP2, which are sequentially and alternately arranged in the first direction X1, are connected to the second gate line GL2. The third red sub-pixel RP3, the third green sub-pixel GP3, and the third transparent sub-pixel WP3, which are sequentially and alternately arranged in the first direction X1, are connected to the third gate line GL3. A similar configuration may be utilized in association with the fourth to eighth red, green, and transparent sub-pixels RP4 to RP8, GP4 to GP8, and WP4 to WP8, and, therefore, further description has been omitted to avoid obscuring exemplary embodiments described herein.

According to exemplary embodiments, the data driver 140 of FIG. 1 is configured to drive the data lines DL1 to DLm, such that the sub-pixels SPX are driven in a dot inversion method, in which a polarity of the sub-pixels is inverted at every sub-pixel in the first and second directions X1 and X2. In other words, adjacent sub-pixels may be driven in association with oppositely polarized data voltages. As such, the gray-scale voltages applied to the sub-pixels SPX adjacent to each other may have complementary polarities to each other.

In order to display an image, in which the frame F (as shown in FIG. 2) has a frequency of about 120 Hz, on the display panel 110*a* including the sub-pixel structure as shown in FIG. 3, each of the first and second sub-frames SF1 and SF2 (as seen in FIG. 2) may have a frequency of about 240 Hz. It is noted that as the frequency of each of the first and second sub-frames SF1 and SF2 becomes faster, the "turn-on" period of the switching element TR in each sub-pixel SPX becomes shorter. As a result, a charge time and a liquid crystal response time of each sub-pixel SPX may be reduced, which may cause deterioration in the display quality.

Figure 4:
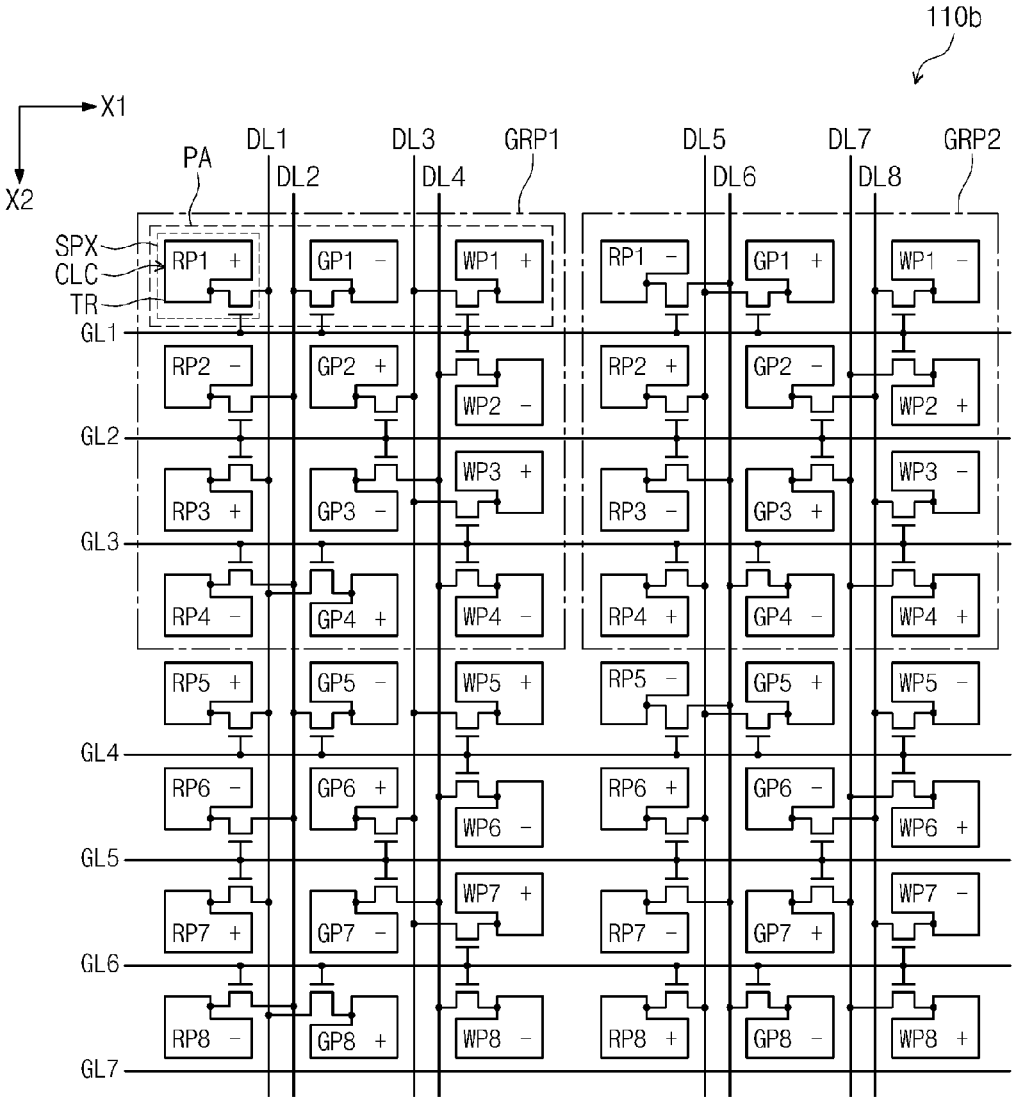
FIG. 4 schematically illustrates an arrangement of sub-pixels in a display panel of the display apparatus of FIG. 1, according to exemplary embodiments.

FIG. 4 schematically illustrates an arrangement of sub-pixels in the display panel 110 of the display device 100 of FIG. 1, according to exemplary embodiments.

Referring to FIG. 4, a display panel 110*b* includes a plurality of sub-pixels. The sub-pixels have the same structure and function, and, therefore, to avoid obscuring exemplary embodiments described herein, one sub-pixel SPX will be described in detail. The sub-pixel SPX includes a switching element TR and a liquid crystal capacitor CLC. The switching element TR is connected to a corresponding data line DL1 and a corresponding gate line GL1.

As described with reference to FIG. 2, the first color filter R, the second color filter G, and the open portion W respectively correspond to the red sub-pixel RP, the green sub-pixel GP, and the transparent sub-pixel WP.

The red sub-pixel RP, the green sub-pixel GP, and the transparent sub-pixel WP may be sequentially and alternately arranged in the first direction X1. The sub-pixels corresponding to the same color may be arranged in the second direction X2.

According to exemplary embodiments, each of first and second sub-pixel groups GRP1 and GRP2 includes "a" sub-pixels in the first direction X1 and "b" sub-pixels in the second direction X2. As illustrated in FIG. 4, each of "a" and "b" is a positive integer, such as, for example, "a" being 3, and "b" being 4.

Each of the first, second, and third gate lines GL1, GL2, and GL3 is disposed between corresponding sub-pixels adjacent to each other in the second direction X2 in each of the first and second sub-pixel groups GRP1 and GRP2. Each of the first, second, and third gate lines GL1, GL2, and GL3 is connected to four sub-pixels of the first sub-pixel group GRP1 and four sub-pixels of the second sub-pixel group GRP2.

For instance, the first gate line GL1 is connected to the red sub-pixel RP1, the green sub-pixel GP1, and the transparent sub-pixel WP1 arranged in a first row of the first sub-pixel group GRP1 and the transparent sub-pixel WP2 arranged in a second row of the first sub-pixel group GRP1. The second gate line GL2 is connected to the red sub-pixel RP2 and the green sub-pixel GP2 arranged in the second row of the first sub-pixel group GRP1 and the red sub-pixel RP3 and the green sub-pixel GP3 arranged in a third row of the first sub-pixel group GRP1. The third gate line GL3 is connected to the transparent sub-pixel WP3 arranged in the third row of the first sub-pixel group GRP1 and the red sub-pixel RP4, the green sub-pixel GP4, and the transparent sub-pixel WP4 arranged in a fourth row of the first sub-pixel group GRP1. Each of the first, second, third, and fourth rows of the first sub-pixel group GRP1 indicates a position of each sub-pixel in the second direction X2.

Further, two data lines may be disposed and extended in the second direction X2 between two corresponding sub-pixels adjacent to each other in the first direction X1. For instance, the first and second data lines DL1 and DL2 are disposed between the red sub-pixels RP1, RP2, RP3, and RP4 and the green sub-pixels GP1, GP2, GP3, and GP4 and are extended in the second direction X2 in the first sub-pixel group GRP1. The third and fourth data lines DL3 and DL4 are disposed between the green sub-pixels GP1, GP2, GP3, and GP4 and the transparent sub-pixels WP1, WP2, WP3, and WP4 and are extended in the second direction X2 in the first sub-pixel group GRP1.

Accordingly, the fifth and sixth data lines DL5 and DL6 are disposed between the red sub-pixels RP1, RP2, RP3, and RP4 and the green sub-pixels GP1, GP2, GP3, and GP4 and are extended in the second direction X2 in the second sub-pixel group GRP2. The seventh and eighth data lines DL7 and DL8 are disposed between the green sub-pixels GP1, GP2, GP3, and GP4 and the transparent sub-pixels WP1, WP2, WP3, and WP4 and are extended in the second direction X2 in the second sub-pixel group GRP2. Each sub-pixel of the first and second sub-pixel groups GRP1 and GRP2 is connected to the corresponding data line to allow the polarities of the sub-pixels to be inverted in the first and second directions X1 and X2 when polarities of the first to eighth data lines DL1 to DL8 are sequentially inverted in the first direction X1, e.g., +, −, +, −, +, −, +, and −.

According to exemplary embodiments, a data signal may be applied to the red sub-pixel RP1, the green sub-pixel GP1, the transparent sub-pixel WP1, and the transparent sub-pixel WP2 of the first sub-pixel group GRP1, which are connected to the first gate line GL1, when the "gate-on" voltage is applied to the first gate line GL1. The data signal may be applied to the red sub-pixel RP2, the green sub-pixel GP2, the red sub-pixel RP3, and the green sub-pixel GP3 of the first sub-pixel group GRP1, which are connected to the second gate line GL2, when the "gate-on" voltage is applied to the second gate line GL2. The data signal may be applied to the transparent sub-pixel WP3, the red sub-pixel RP4, the green sub-pixel GP4, and the transparent sub-pixel WP4 of the first sub-pixel group GRP1, which are connected to the third gate line GL3, when the "gate-on" voltage is applied to the third gate line GL3. In this manner, the sub-pixels arranged in the four rows may be driven using the first, second, and third gate lines GL1, GL2, and GL3.

The sub-pixels of the second sub-pixel group GRP2 are connected to the fifth to eighth data lines DL5 to DL8, and, in this manner, the sub-pixels of the second sub-pixel group GRP2 may be driven according to the dot inversion method. That is, the red sub-pixel RP1 arranged in the first row of the first sub-pixel group GRP1 is connected to the first data line DL1, but the red sub-pixel RP1 arranged in the first row of the second sub-pixel group GRP2 is connected to the sixth data line DL6. Similarly, the green sub-pixel GP1 arranged in the first row of the first sub-pixel group GRP1 is connected to the second data line DL2, but the green sub-pixel GP1 arranged in the first row of the second sub-pixel group GRP2 is connected to the fifth data line DL5.

In this manner, when the display panel **110*b* has a full high definition (FHD) resolution, the number of sub-pixels arranged in the second direction X2 may be 1080, but the number of gate lines may be 810, i.e., (1080/4)×3=810. As such, a time to apply the "gate-on" voltage to each gate line of the display panel 110*b* including 810 gate lines as shown in FIG. 4 may be set longer than a time to apply the "gate-on" voltage to each gate line of the display panel 110*a* including 1080 gate lines as shown in FIG. 3. In this manner, the time to apply the "gate-on" voltage to each gate line of the display panel 110*b*** is increased by the reduced number of gate lines. That is, the number of gate lines is reduced to ¾, although the frequency of each of the first and second sub-frames SF1 and SF2 may be about 240 Hz, and the time used to apply the "gate-on" voltage to each gate line is equal to that when the frequency of each of the first and second sub-frames SF1 and SF2 is about 180 Hz.

As described above, since the "turn-on" period of the switching element TR of each sub-pixel SPX is lengthened, the charge time and the liquid crystal response time of each sub-pixel may be increased. In this manner, the display quality of an image displayed via the display panel **110*b*** may be improved.

Figure 5:
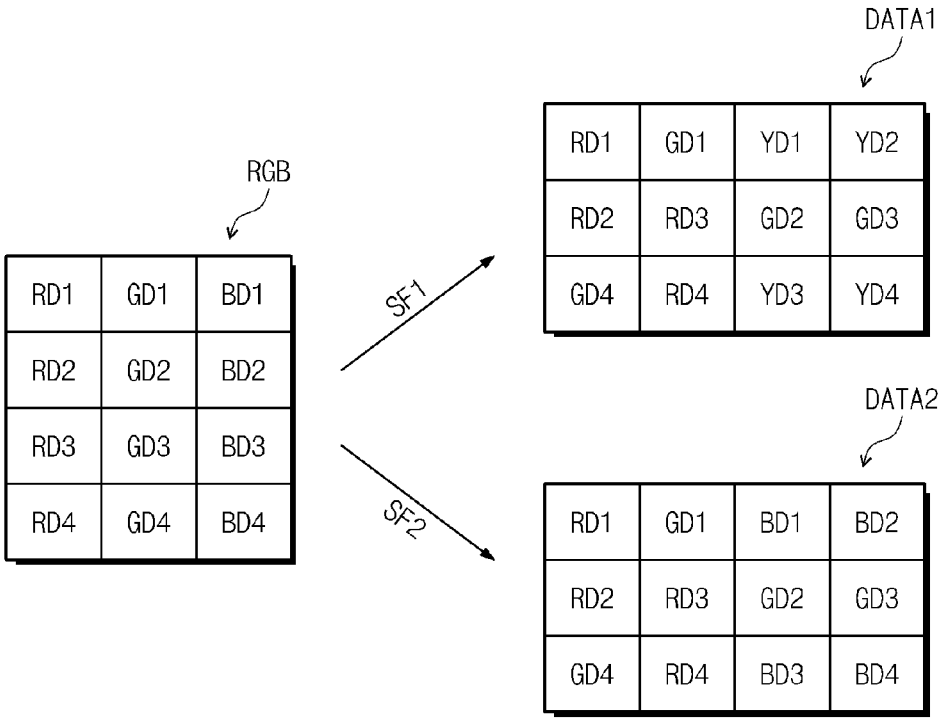
FIG. 5 schematically illustrates a process to convert image signals from a source to data signals utilized to drive the display panel of FIG. 4, according to exemplary embodiments.

FIG. 5 schematically illustrates a process to convert image signals from a source to data signals utilized to drive the display panel **110*b*** of FIG. 4, according to exemplary embodiments.

Referring to FIGS. 4 and 5, when the image signals RGB corresponding to twelve sub-pixels of the first sub-pixel group GRP1, which are arranged in three columns by four rows (i.e., 3×4=12), are provided, the timing controller 120 (shown in FIG. 1) converts the image signals RGB to the data signals DATA applied to the twelve sub-pixels through the four data lines, i.e., the first to fourth data lines DL1 to DL4. In association with the first sub-frame SF1, a first data signal DATA1 is applied to the display panel **110*b*, and a second data signal DATA2 is applied to the display panel 110*b*** in association with the second sub-frame SF2.

Among the image signals RGB, blue image signals BD1, BD2, BD3, and BD4 corresponding to the blue image are converted to yellow data signals YD1, YD2, YD3, and YD4 applied to the display panel **110*b*** in association with the first sub-frame SF1 and converted to blue data signals BD1, BD2, BD3, and BD4 applied to the display panel 110*b* in association with the second sub-frame SF2.

Figure 6:
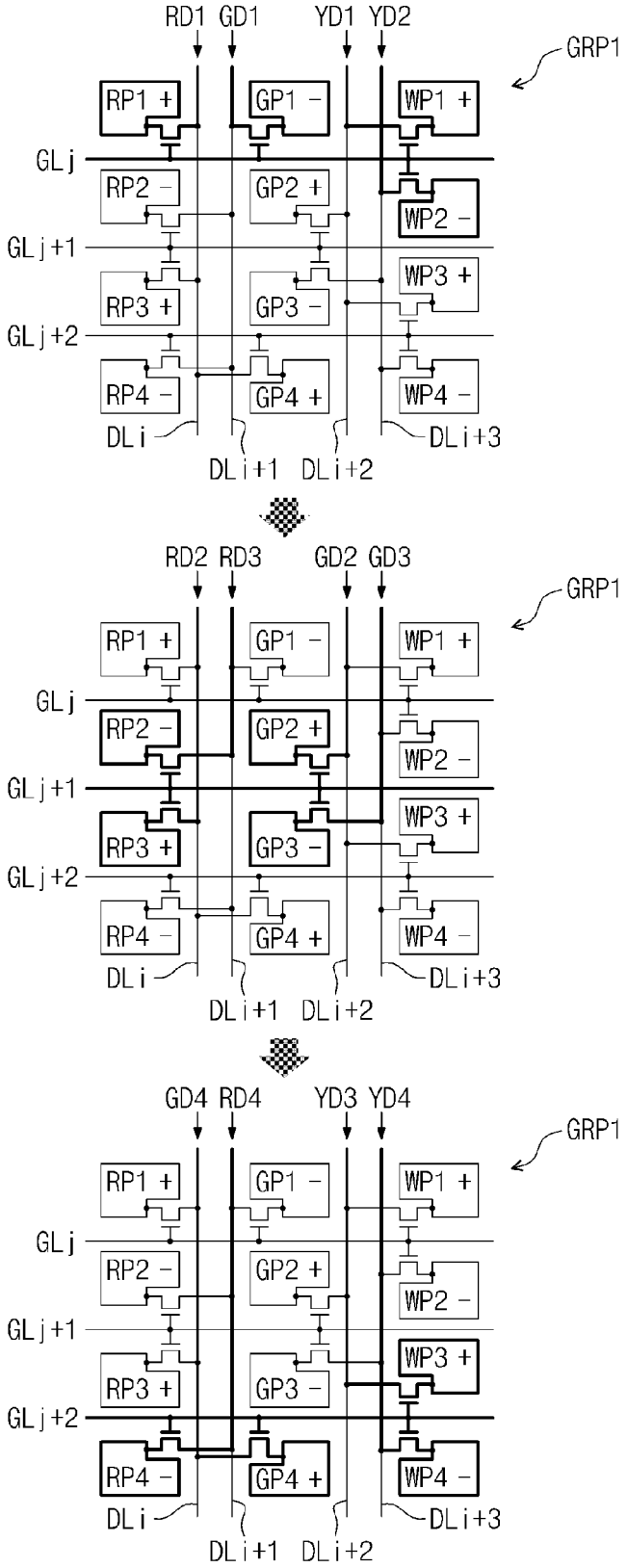
FIG. 6 schematically illustrates a first data signal of FIG. 5 applied to data lines of the display panel of FIG. 4 when gate lines in a first sub-pixel group are sequentially driven in association with a first sub-frame, according to exemplary embodiments.

FIG. 6 schematically illustrates the first data signal DATA1 of FIG. 5 applied to the data lines of the display panel 110*b* of FIG. 4 when the gate lines in the first sub-pixel group GRP1 are sequentially driven in association with the first sub-frame SF1, according to exemplary embodiments.

Referring to FIG. 6, when the "gate-on" voltage is applied to a j-th gate line GLj, the first data signals RD1, GD1, YD1, and YD2 are respectively applied to the data lines DLi, DLi+1, DLi+2, and DLi+3. Accordingly, when the "gate-on" voltage is applied to a j-th gate line GLj, the first data signals RD1, GD1, YD1, and YD2 are respectively applied to the red sub-pixel RP1, the green sub-pixel GP1, the transparent sub-pixel WP1, and the transparent sub-pixel WP2 of the first sub-pixel group GRP1.

When the "gate-on" voltage is applied to the (j+1)th gate line GLj+1, the first data signals RD2, RD3, GD2, and GD3 are respectively applied to the data lines DLi, DLi+1, DLi+2, and DLi+3. In this manner, when the "gate-on" voltage is applied to the (j+1)th gate line GLj+1, the first data signals RD2, RD3, GD2, and GD3 are respectively applied to the red sub-pixel RP3, the red sub-pixel RP2, the green sub-pixel GP2, and the green sub-pixel GP3 of the first sub-pixel group GRP1.

When the "gate-on" voltage is applied to a (j+2)th gate line GLj+2, the first data signals GD4, RD4, YD3, and YD4 are respectively applied to the data lines DLi, DLi+1, DLi+2, and DLi+3. In this manner, when the "gate-on" voltage is applied to the (j+2)th gate line GLj+2, the first data signals GD4, RD4, YD3, and YD4 are respectively applied to the green sub-pixel GP4, the red sub-pixel RP4, the transparent sub-pixel WP3, and the transparent sub-pixel WP4 of the first sub-pixel group GRP1.

According to exemplary embodiments, in response to the above-mentioned driving method, the twelve sub-pixels arranged in four rows by three columns may be driven using the three gate lines GLj, GLj+1, and GLj+2 and the four data lines DLi, DLi+1, DLi+2, and DLi+3.

Figure 7:
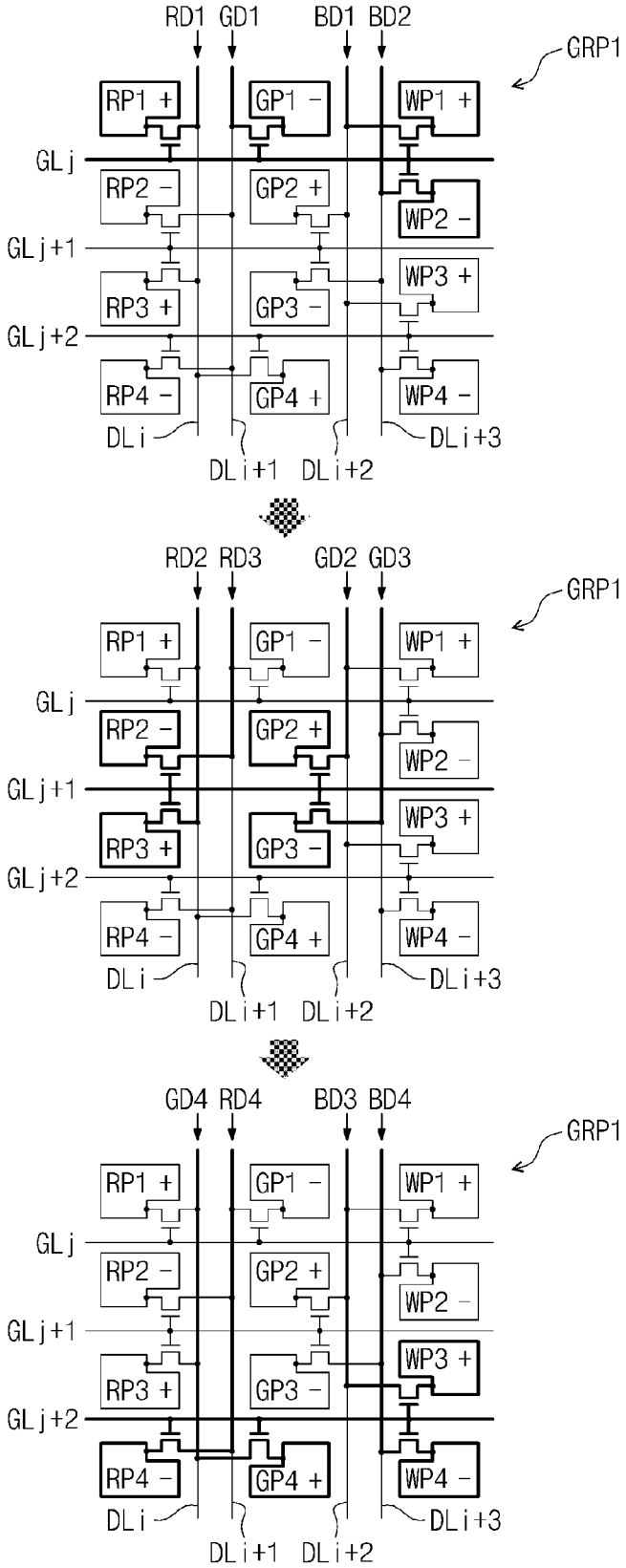
FIG. 7 schematically illustrates a second data signal of FIG. 5 applied to the data lines of the display panel of FIG. 4 when first to third gate lines are sequentially driven in association with a second sub-frame, according to exemplary embodiments.

FIG. 7 schematically illustrates the second data signal DATA 2 of FIG. 5 applied to the data lines of the display panel 110*b* of FIG. 4 when the first to third gate lines are sequentially in association with the second sub-frame SF2, according to exemplary embodiments.

Referring to FIG. 7, when the "gate-on" voltage is applied to the j-th gate line GLj, the second data signals RD1, GD1, BD1, and BD2 are respectively applied to the data lines DLi, DLi+1, DLi+2, and DLi+3. Accordingly, when the "gate-on" voltage is applied to the j-th gate line GLj, the second data signals RD1, GD1, BD1, and BD2 are respectively applied to the red sub-pixel RP1, the green sub-pixel GP1, the transparent sub-pixel WP1, and the transparent sub-pixel WP2 of the first sub-pixel group GRP1.

When the "gate-on" voltage is applied to the (j+1)th gate line GLj+1, the second data signals RD2, RD3, GD2, and GD3 are respectively applied to the data lines DLi, DLi+1, DLi+2, and DLi+3. In this manner, when the "gate-on" voltage is applied to the (j+1)th gate line GLj+1, the second data signals RD2, RD3, GD2, and GD3 are respectively applied to the red sub-pixel RP3, the red sub-pixel RP2, the green sub-pixel GP2, and the green sub-pixel GP3 of the first sub-pixel group GRP1.

When the "gate-on" voltage is applied to the (j+2)th gate line GLj+2, the second data signals GD4, RD4, BD3, and BD4 are respectively applied to the data lines DLi, DLi+1, DLi+2, and DLi+3. In this manner, when the "gate-on" voltage is applied to the (j+2)th gate line GLj+2, the second data signals GD4, RD4, BD3, and BD4 are respectively applied to the green sub-pixel GP4, the red sub-pixel RP4, the transparent sub-pixel WP3, and the transparent sub-pixel WP4 of the first sub-pixel group GRP1.

According to exemplary embodiments, in response to the above-mentioned driving method, the twelve sub-pixels arranged in four rows by three columns may be driven using the three gate lines GLj, GLj+1, and GLj+2 and the four data lines DLi, DLi+1, DLi+2, and DLi+3.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A display apparatus, comprising:

a display panel comprising:

gate lines extended in a first direction, data lines extended in a second direction, sub-pixels, and a first color filter, a second color filter, and a colorless portion sequentially arranged in the first direction in one-to-one correspondence with the sub-pixels; and a light providing unit configured to supply a first color of light and a second color of light different from the first color of light to the display panel in association with a first sub-frame and a second sub-frame, respectively, wherein at least some of the sub-pixels are grouped into a sub-pixel group comprising an "a"×"b" matrix arrangement, the sub-pixel group being connected to an amount "a" of the gate lines and an amount "b" of the data lines, wherein "a" and "b" are positive integers greater than one, and wherein "b" is greater than "a,"

wherein, in association with the sub-pixel group:

a first data line and a second data line are directly disposed between a first sub-pixel corresponding to the first color filter and a second sub-pixel corresponding to the second color filter, the first sub-pixel being directly spaced from the second sub-pixel in the first direction; and a third data line and a fourth data line are directly disposed between the second sub-pixel and a third sub-pixel corresponding to the colorless portion, the second sub-pixel being directly spaced from the third sub-pixel in the first direction, and wherein each of the gate lines associated with the sub-pixel group are directly disposed between a respectively different set of two adjacent sub-pixels directly spaced from one another in the second direction.

2. The display apparatus of claim 1, wherein each of the gate lines associated with the sub-pixel group is connected to an amount "b" of sub-pixels of the sub-pixel group.

3. The display apparatus of claim 2, wherein each of the amount "b" of the sub-pixels connected to the same gate line are each connected to a different data line associated with the sub-pixel group.

4. The display apparatus of claim 1, further comprising:

a first gate line connected to a first sub-pixel, a second sub-pixel, and a third sub-pixel arranged in a first row of the sub-pixel group and a third sub-pixel arranged in a second row of the sub-pixel group;

a second gate line connected to a first sub-pixel and a second sub-pixel arranged in the second row of the sub-pixel group and a first sub-pixel and a second sub-pixel arranged in a third row of the sub-pixel group; and a third gate line connected to a third sub-pixel arranged in the third row of the sub-pixel group and a first sub-pixel, a second sub-pixel and a third sub-pixel arranged in a fourth row of the sub-pixel group.

5. The display apparatus of claim 4, wherein:

the first sub-pixel, the second sub-pixel, and the third sub-pixel arranged in the first row of the sub-pixel group and connected to the first gate line, and the third sub-pixel arranged in the second row of the sub-pixel group and connected to the first gate line, are respectively connected to the first data line, a second data line, the third data line, and a fourth data line associated with the sub-pixel group;

the first sub-pixel and the second sub-pixel arranged in the second row of the sub-pixel group and connected to the second gate line, and the first sub-pixel and the second sub-pixel arranged in the third row of the sub-pixel group and connected to the second gate line, are respectively connected to the second data line, the third data line, the first data line, and the fourth data line associated with the sub-pixel group; and the third sub-pixel arranged in the third row of the sub-pixel group and connected to the third gate line, and the first sub-pixel, the second sub-pixel, and the third sub-pixel arranged in the fourth row of the sub-pixel group and connected to the third gate line, are respectively connected to the third data line, the second data line, the first data line, and the fourth data line associated with the sub-pixel group.

6. The display apparatus of claim 4, wherein:

the first sub-pixel, the second sub-pixel, and the third sub-pixel arranged in a first row of the sub-pixel group and connected to the first gate line, and the third sub-pixel arranged in a second row of the sub-pixel group and connected to the first gate line, are respectively connected to a second data line, the first data line, a fourth data line, and the third data line associated with the sub-pixel group;

a first sub-pixel and a second sub-pixel arranged in the second row of the sub-pixel group and connected to the second gate line, and the first sub-pixel and the second sub-pixel arranged in a third row of the sub-pixel group and connected to the second gate line, are respectively connected to the first data line, the fourth data line, the second data line, and the third data line associated with the sub-pixel group; and a third sub-pixel arranged in the third row of the sub-pixel group and connected to the third gate line, and the first sub-pixel, the second sub-pixel, and the third sub-pixel arranged in a fourth row of the sub-pixel group and connected to the third gate line, are respectively connected to the fourth data line, the first data line, the second data line, and the third data line associated with the sub-pixel group.

7. The display apparatus of claim 1, wherein:

adjacently disposed sub-pixels of the sub-pixel group are configured to be driven by oppositely polarized data voltages.

8. The display apparatus of claim 1, wherein:

the display panel is configured to display an image in a unit frame comprising the first sub-frame and the second sub-frame; and the light providing unit is configured to sequentially supply the first color of light and the second color of light in association with the first sub-frame and the second sub-frame, respectively.

9. The display apparatus of claim 8, wherein:

the first color filter comprises a red color filter; and the second color filter comprises a green color filter.

10. The display apparatus of claim 9, wherein:

the first color of light is yellow; and the second color light is blue.

11. The display apparatus of claim 1, further comprising:

a controller configured to:

receive image signals from a source, convert the image signals into data signals, and apply the data signals to the data lines, wherein the data signals comprise "a"×"b" data signals applied to the "a"×"b" sub-pixels of the sub-pixel group via the amount "b" of the data lines.

12. The display apparatus of claim 1, wherein "a" corresponds to three columns and "b" corresponds to four rows.

13. The display apparatus of claim 1, wherein:

the sub-pixels are grouped into a plurality of sub-pixel groups comprising the sub-pixel group; and the plurality of sub-pixel groups is sequentially arranged in each of the first and second directions.

14. The display apparatus of claim 1, wherein:

the colorless portion is a transparent filter disposed on a same or different plane as the first and second color filters.

* * * * *